US006616265B2

(12) United States Patent
Shindo et al.

(10) Patent No.: US 6,616,265 B2
(45) Date of Patent: Sep. 9, 2003

(54) SUCTION CAP FOR INK-JET RECORDING APPARATUS

(75) Inventors: Tatsuya Shindo, Nagoya (JP); Motohito Hino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/011,279

(22) Filed: Dec. 11, 2001

(65) Prior Publication Data

US 2002/0075348 A1 Jun. 20, 2002

(30) Foreign Application Priority Data

Dec. 14, 2000 (JP) ..... 2000-379881
Oct. 25, 2001 (JP) ..... 2001-327212

(51) Int. Cl.[7] ..... B41J 2/165
(52) U.S. Cl. ..... 347/29; 347/30
(58) Field of Search ..... 347/29, 35, 30, 347/22

(56) References Cited

U.S. PATENT DOCUMENTS 5,534,897 A * 7/1996 Anderson et al. ..... 347/32
6,007,177 A * 12/1999 Takanaka et al. ..... 347/28

FOREIGN PATENT DOCUMENTS

| | | |
|---|---|---|
| JP | 9-300641 A | 11/1997 |
| JP | 2806611 B2 | 7/1998 |
| JP | 2841701 B2 | 10/1998 |

* cited by examiner

*Primary Examiner*—Thinh Nguyen
(74) *Attorney, Agent, or Firm*—Oliff & Berridge, PLC

(57) ABSTRACT

The invention includes a suction cap that does not retain ink therein. The suction cap includes a cap member having a recess and a suction opening formed therein and a capillary force generating member disposed in the recess. When a recovery operation is performed for ink ejection using the suction cap, ink sucked from a nozzle flows downwardly from a tilt surface of the recess due to gravity and a suction force applied through the suction opening. The ink impinges a side face of a projection of the capillary force generating member, flowing into defined narrow spaces, due to the action of capillary force of the ink, and flowing toward the suction opening. The ink in the defined narrow spaces is discharged by the suction force applied through the suction opening to outside the suction cap.

31 Claims, 10 Drawing Sheets

SUCTION CAP FOR INK-JET RECORDING APPARATUS

BACKGROUND OF THE INVENTION

1. Field of Invention

The invention relates to an ink-jet recording apparatus that performs recording by ejecting an ink droplet, and more particularly, to the ink-jet recording apparatus that has a recovery mechanism for ink ejection.

2. Description of Related Art

A known recording apparatus, such as a printer, that performs printing on a recording medium, such as a sheet of paper and an overhead transparency film, includes a print head of, for example, an ink-jet type, a dot impact type, or a thermal transfer type. Specially, the ink-jet print head performs high-speed and high-quality printing with a low noise level, without having complicated structures.

In the ink-jet head, a plurality of nozzles that eject ink are formed. In order to perform high-quality printing using the ink-jet print head, ink in and around the nozzles needs to be maintained in appropriate conditions. More specifically, when the ink is placed in inappropriate conditions where, for example, the ink contains air bubbles or dirt or other contaminants, or is dried and becomes viscous due to evaporation of the ink solvent, the ink may not be ejected or may be inappropriately ejected. In such cases, a recovery operation to obtain proper ink ejection is performed to clear the inappropriate conditions of the ink or to eliminate the causes of the ink ejection failure.

In order to perform the recovery operation, some ink-jet recording apparatuses include a cap that covers an ejection surface of the ink-jet print head where openings of the nozzles are provided, a suction pump that sucks ink from the ink-jet print head through a tube connected to the cap, by applying a suction force to the cap, and a waste ink reservoir that receives ink sucked by the suction pump. The suction pump is driven when the cap covers the nozzle ejection surface, to generate a negative pressure in the cap, thereby forcibly discharging ink from the ink-jet print head. Thus, causes of the ink ejection failure are eliminated.

The ink received in the cap by the recovery operation is required to be completely discharged from the cap, through the suction pump, to the waste ink reservoir, by the application of the suction force. However, the ink may not be discharged completely from the cap, but may remain in the cap, due to the structure of the cap.

If the ink remains in the cap, the ink may leak into the ink-jet printer, or solidify in the cap or on the edges, which prevents the cap from covering the ejection surface tightly. If the cap is used to cover the ejection surface when recording is not performed, the ink remaining in the cap may be attached to the ejection surface when the cap covers the ejection surface. Such an attachment of ink to the ejection surface causes, for example, the ink to be ejected in a direction shifted or varied from a predetermined direction, resulting in an ink ejection failure.

To solve the above-described problems, an ink-jet recording apparatus is disclosed in Japanese Patent No. 2806611. In Japanese Patent No. 2806611, the cap has a 0.4 mm to 0.7 mm-wide groove at a bottom wall of a recess of a cap which defines a space or room with the print head ejection surface when the cap covers the ejection surface. The ink is collected in the groove and the collected ink is discharged from the cap through a suction opening formed in the bottom wall of the recess.

However, when the cap having the groove at the bottom wall of the recess thereof is formed by molding, the groove is required to have a certain width, to prevent a mold for the cap from breaking where the groove is formed. Accordingly, a cap having a narrow groove is difficult to form by molding. Therefore, the groove is, in reality, formed with an unnarrow, or wide, width. However, the groove with a wide width does not lead the ink in the cap completely to the suction opening, so that the ink is likely to remain in the cap. If the cap is formed by cutting, manufacturing processes for the cap become complicated, resulting in an increase in cost so as to become impractical.

SUMMARY OF THE INVENTION

To solve the above-described drawbacks, the invention provides an ink-jet recording apparatus including a cap that is formed with a simple structure and does not leave ink in the cap.

An ink-jet recording apparatus according to the invention may include a recording head including an ejection surface and at least one nozzle formed thereon for recording onto a recording medium by ejecting ink from the nozzle, a cap device for covering the ejection surface of the recording head, and a suction device connected to the suction opening formed in the recess of the cap device and able to suck the ink through the nozzle and discharge the sucked ink from the cap device through a suction opening.

The cap device may include a cap member and a capillary force generating member. The cap member includes a contact portion able to be in contact with the ejection surface and a recess forming a room with the ejection surface of the recording head when the cap member contacts the ejection surface of the recording head, the suction opening communicating with the recess through which ink is sucked. The capillary force generating member may be separately formed from the cap member. The capillary force generating member may be disposed in the cap member to form spaces with a inner surface of the recess of the cap member so that capillary force is generated toward a part of the inner surface of the recess where the suction opening is formed.

In the ink-jet recording apparatus having the above-described structure, as the suction device sucks the ink from the nozzles when the cap member of the cap device contacts the ejection surface of the recording head, the ink is received in the recess of the cap member. By disposing the capillary force generating member in the recess, spaces are formed between the capillary force generating member and the inner surface of the recess. In the spaces a capillary force is generated toward a part of the inner surface of the recess where the suction opening is formed. Therefore, the ink in the recess can be discharged smoothly outside the cap device, through the suction opening, without being left in the recess, by a suction force applied by the suction device.

Because the ink does not remain in the cap device, problems such that the ink-jet printing apparatus is contaminated with the ink remaining in the cap device or the occurrence of an ink ejection failure can be prevented. Therefore, an ink-jet recording apparatus that maintains high print quality can be provided.

BRIEF DESCRIPTION OF THE DRAWINGS

Exemplary embodiments of the invention will be described in detail with reference to the following figures wherein.

DETAILED DESCRIPTION OF PREFERRED EMBODIMENTS

Exemplary embodiments of the invention will be described in detail with reference to the figures.

Figure 1:
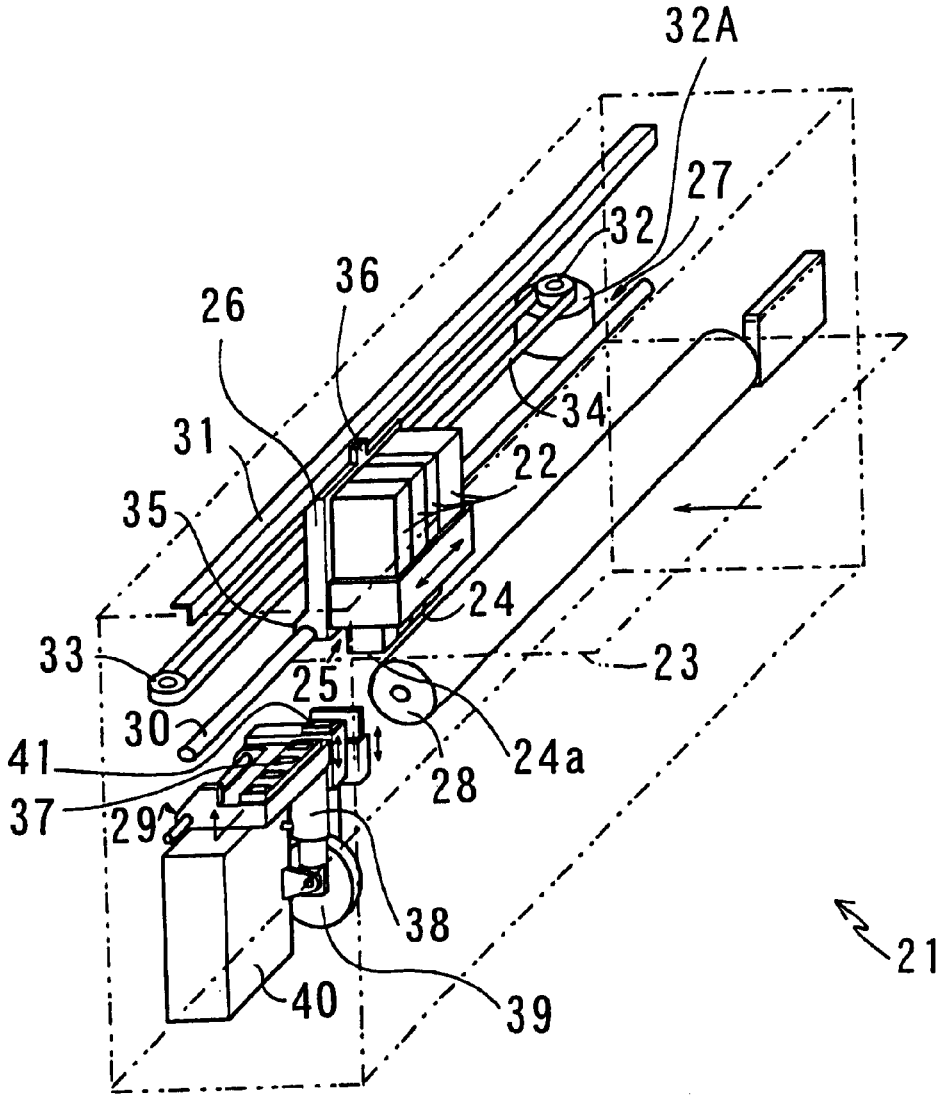
FIG. 1 is a perspective view of a color ink-jet printer of an ink-jet recording apparatus according to an exemplary embodiment of the invention.
Figure 2:
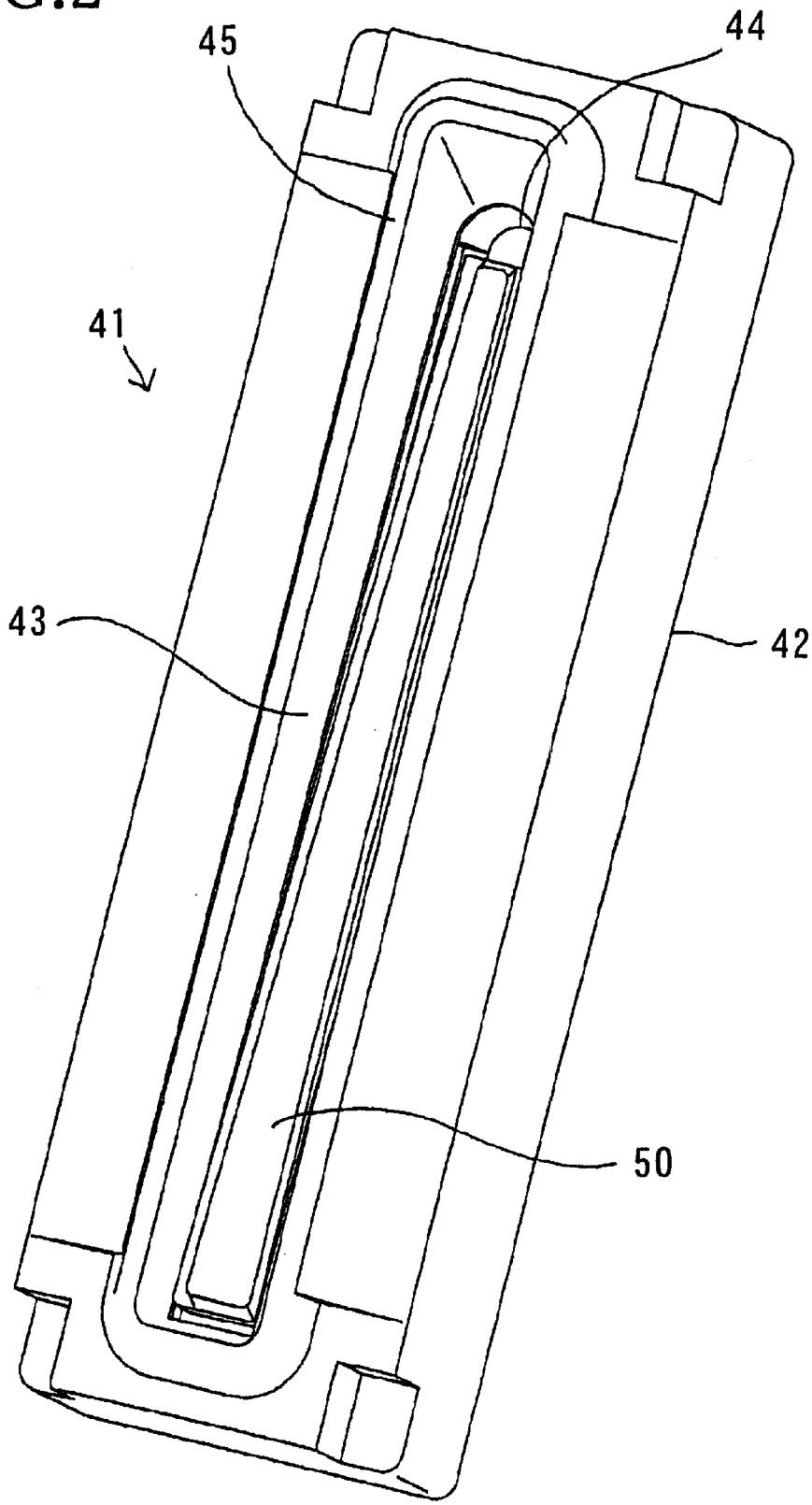
FIG. 2 is a perspective view of a suction cap.

Referring to FIG. 1, the configuration of an ink-jet printer 21 as an ink-jet recording apparatus will be described below. As shown in FIG. 1, the ink-jet printer 21 includes ink cartridges 22, ink-jet print heads 24, a carriage 26, a drive unit 27, a platen roller 28, and a purge device 29. Each ink cartridge 22, as an ink supply member, contains one of yellow, magenta, cyan and black ink. The ink-jet print heads 24, as recording heads, perform printing onto a paper sheet 23, for example, as a recording medium. The carriage 26, as a supporting member, supports the ink cartridges 22 and the ink-jet print heads 24 mounted thereon. The drive unit 27 linearly reciprocates the carriage 26. The platen roller 28 extends in the direction the carriage 26 reciprocates, and is disposed opposite to the ink-jet print heads 24.

The drive unit 27 includes a carriage shaft 30, a guide plate 31, pulleys 32, 33 and an endless belt 34. The carriage shaft 30 is provided at a lower end portion of the carriage 26 and extends parallel to the platen roller 28. The guide plate 31 is provided at an upper portion of the carriage 26 and extends parallel to the carriage shaft 30. The pulleys 32, 33 are disposed between the carriage shaft 30 and the guide plate 31, at each end portion of the carriage shaft 30. The endless belt 34 is placed over the pulleys 32, 33.

Provided at a lower portion of the carriage 26 is a carriage shaft supporting portion 35 into which the carriage shaft 30 is inserted. At an upper portion of the carriage 26, a guide plate contact portion 36 is provided where the guide plate 31 contacts thereto. The endless belt 34 is connected to a rear surface of the carriage 26.

When the pulley 32 is rotated by a motor 32A in a forward or reverse direction, the carriage 26, to which the endless belt 34 is connected, is linearly reciprocated along the carriage shaft 30 and the guide plate 31, in the direction of the width of the paper sheet 23.

The paper sheet 23 is fed from a sheet cassette(not shown) provided in the ink-jet printer 21. The paper sheet 23 is fed between an ejection surface 24*a* of the ink-jet print heads 24, facing downwardly with respect to the vertical direction, and the platen roller 28. Printing is conducted by ejecting ink from the nozzles of the ink-jet print heads 24. Thereafter, the paper sheet 23 is discharged. Paper feeding and discharging mechanisms are omitted in FIG. 1.

The purge device 29 is provided to a side of the platen roller 28. The purge device 29 is arranged so as to face the ejection surface 24*a* when a print head unit 25 is in a reset position (in the forward position in FIG. 1 provided in the main scanning direction outwardly of an end of a printing area). The purge device 29 is used to clear an ink ejection failure, such as when air bubbles or dirt or other containments are trapped in the nozzles, or the ink dries and becomes viscous due to the evaporation of ink solvent. The purge device 29 includes a suction cap 41, as a cap member, that covers the nozzles of the ink-jet print heads 24, a suction pump 38 and a cam 39, as a suction device, and a waste ink reservoir 40.

When the print head unit 25 is in the reset position, the cam 39 is driven by a motor (not shown), to cover the ejection surface 24*a* of a print head 24 with the suction cap 41, and then to forcibly discharge the ink, in the print head 24, containing air bubbles or dirt that cause the ink ejection failure, from the nozzles using the suction pump 38, by a purge operation. Therefore, the ink-jet print head 24 is brought into recovery. Thus, the recovery operation for ink ejection is performed to prevent the ink ejection failure from being caused due to clogged ink or the air bubbles produced at the time when the ink is first introduced into the print head 24. The sucked ink, which is likely to cause the ink ejection failure, is received and stored in the waste ink reservoir 40.

In the embodiments, the suction cap 41 has a size to cover the nozzles of one print head for one color at a time. When the purge operation is performed for the nozzles for more than one color, a series of operations, of covering the ejection surface 24*a* with the suction cap 41 and sucking the ink using the suction pump 38, is performed for the nozzles for each of the colors. In this example, four operations are performed to clean the nozzles of each of the four colors. The carriage 26 is constructed to be moved in the main scanning direction to cover the ejection surface 24*a* for a desired color, when necessary.

Provided to a side of the suction cap 41 are protective caps 37 that cover all nozzles of each color at one time. When the print head unit 25 is in a stop position (in the forward end position provided in the main scanning direction, i.e., right end of carriage shaft 30, as shown in FIG. 1), the protective caps 37 cover the ejection surfaces 24*a* of the ink-jet print heads 24 for all colors.

As shown in FIGS. 2 through 5, the suction cap 41 includes a cap member 42 and a capillary force generating member 50. The cap member 42 has a recess 43 that forms a room with the ejection surface 24*a* of the print head 24 when the suction cap 41 contacts the surface 24*a*. The capillary force generating member 50 is disposed in the recess 43 of the cap member 42. The cap member 42 is formed of an elastic material, for example, butyl-rubber. The cap member 42 has a contact portion 45 which contacts the ejection surface 24*a*. The recess 43 extends in the same direction as a row of nozzles of the ink-jet print heads 24. The nozzle row is not illustrated in the drawings. However, the nozzle row is provided, in a manner similar to the known ink-jet print heads, in the direction orthogonal to the reciprocating movement directions of the carriage 26. The recess 43 includes a first recessed portion 43*a* located on the side of ejection surface 24*a* when the cap member 42 faces the ejection surface 24*a*, a second recessed portion 43*b* continuous with the first recessed portion 43*a* and located on the side of the first recessed portion 43*a* opposite to the ejection surface 24*a*, and a suction opening 44 formed at a bottom 46 of the second recessed portion 43*b*.

Figure 3:
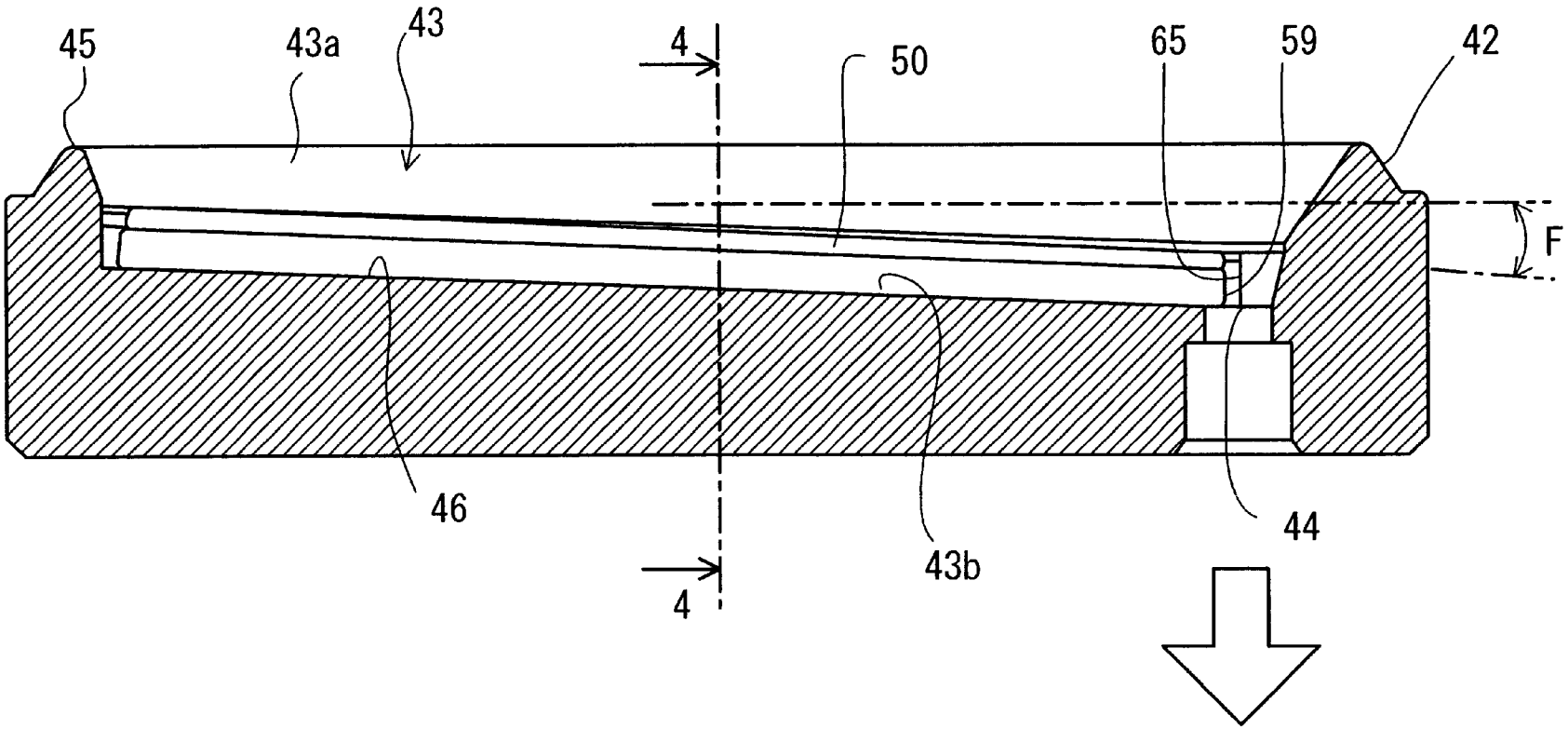
FIG. 3 is a sectional view of the suction cap, taken along a length thereof.
Figure 5:
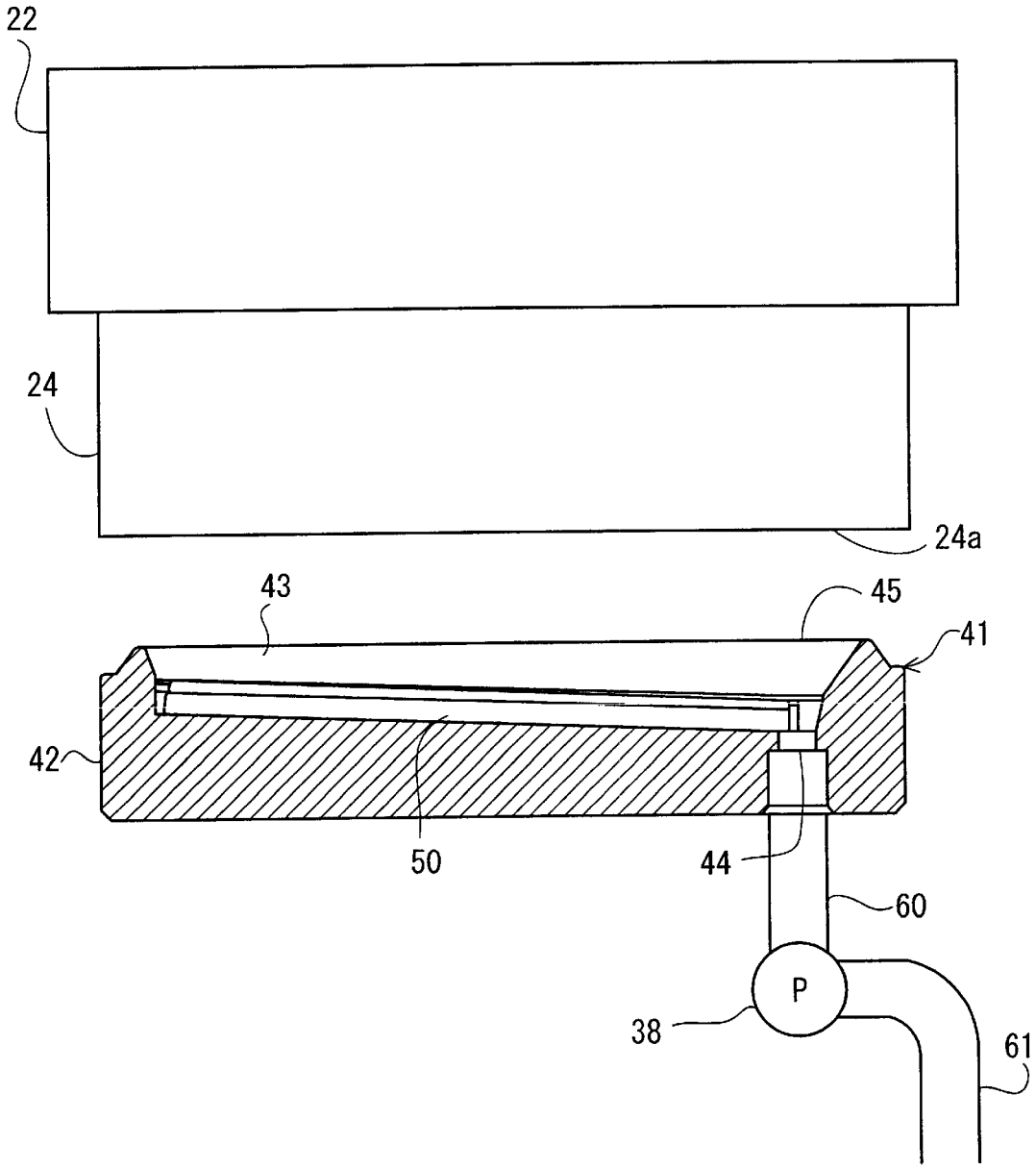
FIG. 5 is an explanatory view of the suction cap and an ink-jet print head facing each other.

The first recessed portion 43*a* of the recess 43 is contiguous to the contact portion 45 and provided downwardly from the contact portion 45. The first recessed portion 43*a* has tapered inner surfaces (tilt surfaces 48), gradually becoming narrower toward the second recessed portion 43*b*, so as to make the opening area of the first recessed portion 43*a* smaller. The second recessed portion 43*b* extends in the same direction as a nozzle row of the ink-jet print heads 24. The second recessed portion 43*b* is formed like a groove whose one end in the longitudinal direction is placed lower than the other end, as shown in FIGS. 3 and 5. The suction opening 44 is formed on a lowest end portion of the bottom 46 of the second recessed portion 43*b*, with respect to the vertical direction.

Formed at the lower parts of the inner surfaces (tilt surfaces 48) of the first recessed portion 43*a* are protrusions 47 that protrude so as to narrow the upper opening portion of the second recessed portion 43*b*. The protrusions 47 are deformable due to the elasticity of the rubber material.

As shown in FIG. 5, the suction opening 44 is connected to the suction pump 38, through a tube 60. The suction pump 38 is connected to the waste ink reservoir 40 (shown in FIG. 1), through a tube 61.

Figure 4:
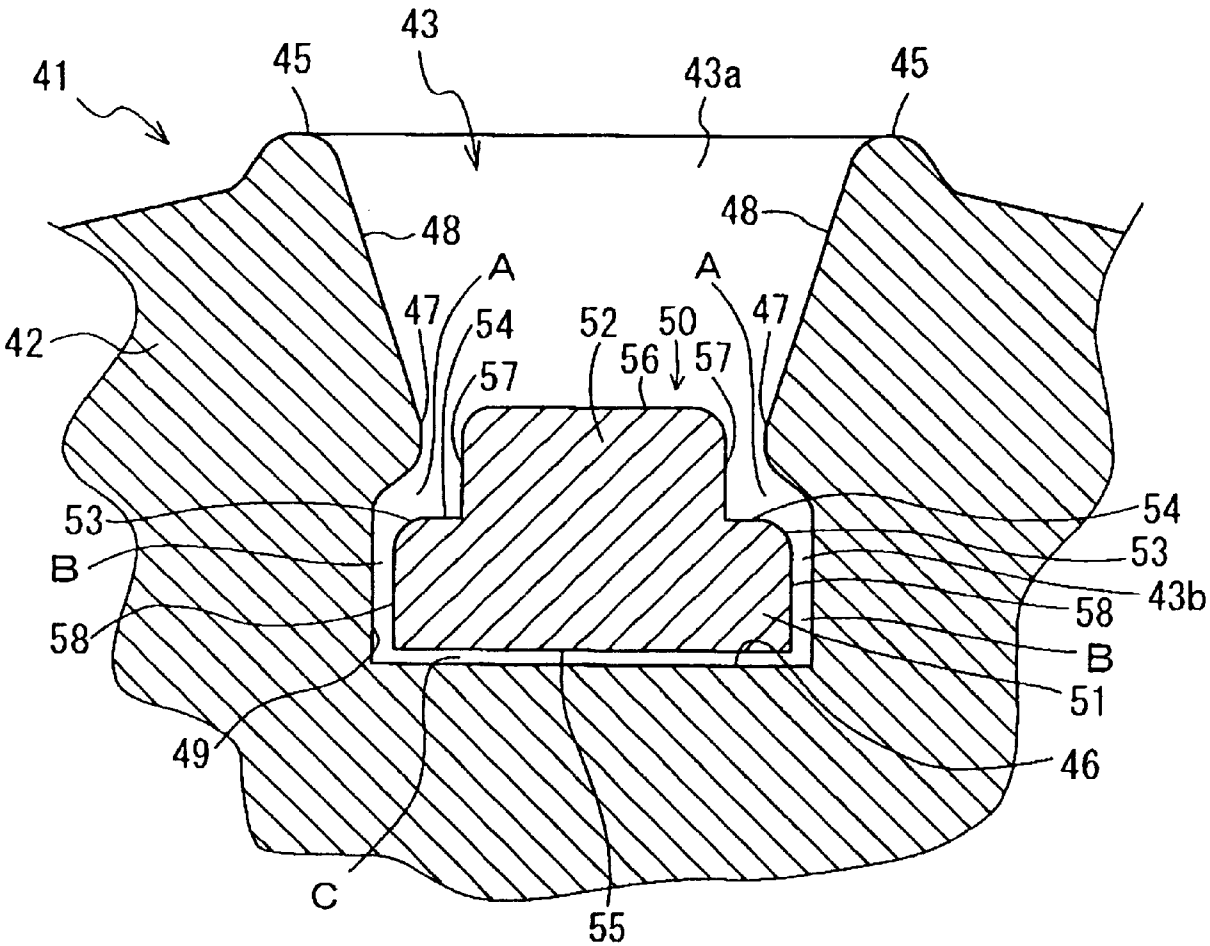
FIG. 4 is a sectional view of the suction cap, taken along a line 4—4 in FIG. 3.
Figure 6:
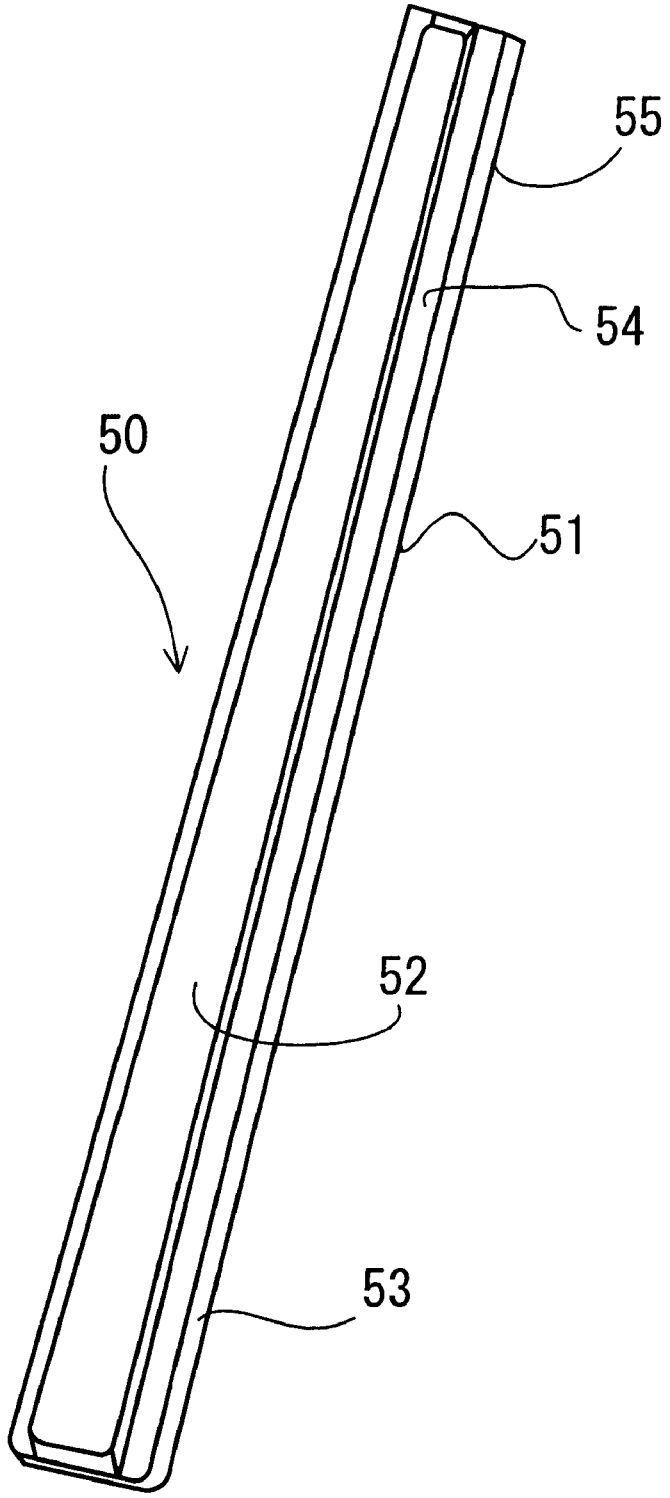
FIG. 6 is a perspective view of a capillary force generating member according to a first embodiment.

The capillary force generating member 50 is formed of resin material, for example, polyacetal resin, by molding. As shown in FIG. 6, the capillary force generating member 50 is integrally formed with a plate-like base 51 and a projection 52 provided at a top surface 54 of the base 51. The width of the projection 52 is smaller than the width of the base 51. The length of the projection 52 is approximately the same as the length of the base 51 and the height of the projection has a downward slope toward the end adjacent the suction opening 44. As shown in FIG. 4, the outline of the capillary force generating member 50 is a substantially an upside down "T" letter shape. The width of the base 51 is longer than the distance between the protrusions 47,47 and slightly smaller than the distance between side inner surfaces 49 of the second recessed portion 43*b*. The height of the base 51 between the top surface 54 and a bottom surface 55 is shorter than the distance between the bottom 46 of the second recessed portion 43*b* and the protrusion 47. Each end portion of the top surface 54 of the base 51 in the direction of the width thereof serves as an engagement portion 53 that engages with a protrusion 47 of the recess 43.

To set the capillary force generating member 50 into the recess 43 of the cap member 42, while facing the bottom surface 55 of the base 51 of the capillary force generating member 50 toward the bottom 46 of the second recessed portion 43*b*, the base 51 is inserted through the opening of the first recessed portion 43*a* toward the bottom 46. The base 51 is disposed between the side inner surfaces 49 below the protrusions 47 by deforming the protrusions 47. Thus, the capillary force generating member 50 is set into the second recessed portion 43*b* of the cap member 42.

In the state where the capillary force generating member 50 is set into the second recessed portion 43*b*, a top face 56 of the projection 52 of the capillary force generating member 50 is disposed above the protrusions 47 of the recess 43 (toward the opening of the first recessed portion 43*a*), as shown in FIG. 4. Further, as shown in FIG. 3, an end of the capillary force generating member 50 in the direction of the length thereof partially covers the suction opening 44 on the side of the second recessed portion 43*b*. The movement of the capillary force generating member 50 in the longitudinal directions is regulated, with an end 59 thereof, by a regulating surface 65 extending from the side inner surfaces 49 of the second recessed portion 43*b*. Therefore, the suction opening 44 on the side of the recess 43 is not completely but partially covered with the capillary force generating member 50.

As shown in FIG. 4, a space A is formed by the protrusion 47 of the recess 43, a side face 57 of the projection 52, and the top surface 54 of the base 51 of the capillary force generating member 50. In the space A, the distance between the protrusion 47 of the recess 43 and the side face 57 of the projection 52 is approximately 0.1 mm to 0.3 mm. When the distance between the protrusion 47 and the side face falls within the range of 0.1 mm to 0.3 mm, ink was not left in the recess 43. In addition to the space A, a very small space B is formed between the side inner surface 49 of the second recessed portion 43*b* and a side surface 58 of the base 51. The space B is, for example, 0.05 mm and narrower than the space between the protrusion 47 and the side face 57. The capillary force generating member 50 is inserted into the second recessed portion 43*b* of the cap member 42 but not attached thereto. Therefore, a fine space C is formed between the bottom surface 55 of the base 51 and the bottom 46 of the second recessed portion 43*b*. Capillary force is generated, due to the spaces A, B, and C, toward the bottom 46 of the second recessed portion 43*b* where the suction opening 44 is formed.

The recovery operation for ink ejection using the suction cap 41 structured as described above will be described. When the print head unit 25 is in the reset position, the cam 39 is driven by a motor (not shown) to cover the ejection surface 24*a* of a print head 24 with the suction cap 41 by contacting the contact portion 45 of the suction cap 41 to the ejection surface 24*a*, thereby forming a room defined by the ejection surface 24*a* and the recess 43. Then, a negative pressure is produced in the enclosed room using the suction pump 38 driven by the cam 39, to suck the ink from the ink-jet print head 24 through the nozzles. The sucked ink is discharged into the waste ink reservoir 40.

Thereafter, the contact portion 45 of the suction cap 41 is separated from the ejection surface 24*a* of the ink-jet print head 24, by driving the cam 39. In this state, the suction pump 38 is further driven to discharge the ink in the recess 43 of the suction cap 41 outside the cap 41, through the suction opening 44. At this time, the ink on the tilt surface 48 of the recess 43 flows downwardly due to gravity and the suction force applied through the suction opening 44. The ink impinges on the side face 57 of the projection 52 of the capillary force generating member 50, flowing into the space A. The ink flows from the space A to the spaces B and C, and then toward the suction opening 44 by the capillary action of the ink. The ink in the spaces B and C is discharged from the suction cap 41, through the suction opening 44, by the application of the suction force.

As described above, the suction cap 41 has the capillary force generating member 50 disposed in the second recessed portion 43*b*, which is formed separately from the cap member 42, having the recess 43 and the suction opening 44, thereby forming the small spaces A, B, and C. The capillary force is generated toward the bottom 46 where the suction opening 44 is formed. Therefore, the ink received by the recess 43 of the cap member 42 is led to the bottom 46 of the recess 43, where the suction opening 44 is formed, by the capillary force generated in the space A, as well as the spaces B and C, which are smaller than the space A. The ink is discharged outside the suction cap 41, without leaving behind ink in the recess 43, by the suction force applied through the suction opening 44.

The capillary force generating member 50 and the cap member 42 are readily formed by molding. In addition, because the capillary force generating member 50 is only inserted into the second recessed portion 43*b* of the cap member 42, the manufacturing process for the suction cap 41 is not complicated.

The protrusions 47 of the recess 43 of the cap member 42 prevent the capillary force generating member 50, which is disposed in the recess 43 by simply inserting the member 50 into the recess 43, from coming out from the second recessed portion 43*b*. Because the capillary force generating member 50 is not attached to the recess 43, a very small space C is formed between the bottom surface 55 of the base 51 and the bottom 46 of the recess 43. The capillary force generated in the very small space C attracts the ink in the vicinity of the space C, to the space C. Consequently, the ink in the recess 43 is discharged smoothly, without leaving behind ink in the recess 43, outside the suction cap 41 by the suction force applied through the suction hole 44.

The ink on the tilt surface 48 of the first recessed portion 43*a* flows downwardly due to gravity and the suction force applied through the suction opening 44. Then, the ink impinges the side face 57 of the projection 52 of the capillary force generating member 50, flowing into the space A, which is formed by the protrusion 47 of the recess 43, the top surface 54 (the engagement portion 53) of the base 51, and the side face 57 of the projection 52, because the top face 56 of the projection 52 of the capillary force generating member 50 is disposed above the protrusions 47 of the recess 43. The ink flowing into the space A is then led to the spaces B and C by the capillary force generated therein. The ink in the spaces B and C is subjected to the suction force applied by the suction pump 38. Therefore, the ink is discharged from the suction cap 41 through the suction opening 44, by the application of the suction force, without leaving behind ink on the capillary force generating member 50.

The suction force by the suction pump 38 is reliably applied to the ink in the spaces B and C through the suction opening 44, by covering a part of the suction opening 44 on the side of the second recessed portion 43*b*. The ink in the recess 43 is discharged, by the suction force applied by the suction pump 38, outside the suction cap 41, through the spaces B and C, and the suction opening 44.

When the capillary force generating member 50 was, for example, sandblasted or coated with an elastomer to have a better wettability than the inner surface of the recess 43, the ink in the recess 43 could be discharged smoothly, through the suction opening 44, outside the suction cap 41 without leaving the ink in the recess 43, with a synergism with the capillary force generated in the spaces A, B, and C. Similar results were obtained even when corners of the second recessed portion 43*b* and the capillary force generating member 50 were not sharp or the top face 56 of the capillary force generating member 50 was substantially flat.

Because the ejection surfaces 24*a* of the ink-jet print heads 24 face downwardly with respect to the vertical direction and the suction opening 44 is formed on the lowest end portion of the tilted bottom 46 of the second recessed portion 43*b*, with respect to the vertical direction, the ink sucked from the nozzles of the ink-jet print head 24, in the direction of gravity and received in the recess 43, is led to the suction opening 44 due to gravity. The ink in the recess 43 is discharged, outside the suction cap 41 by the suction force applied through the suction opening 44, without leaving ink in the recess 43.

Figure 7:
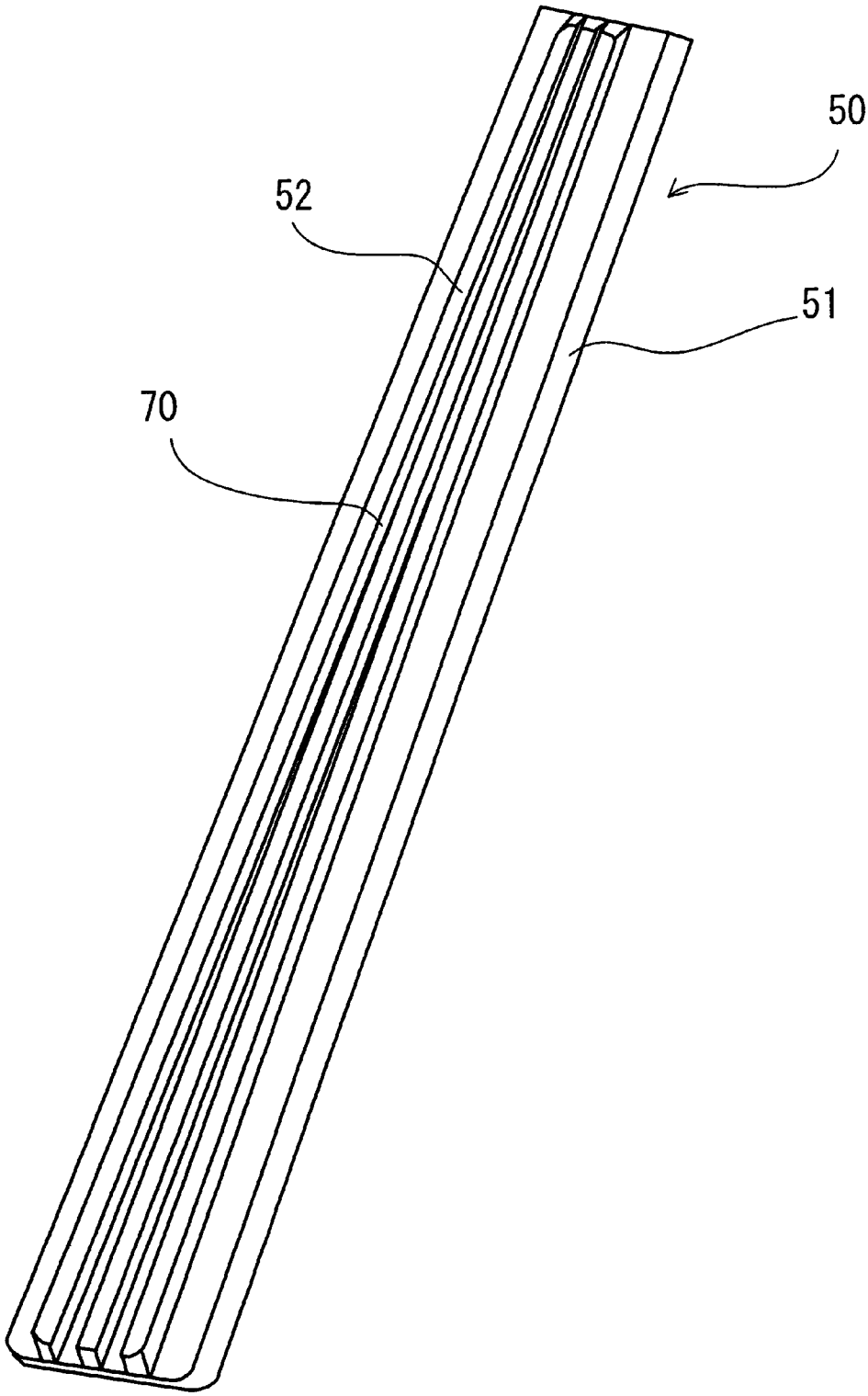
FIG. 7 is a perspective view of a capillary force generating member according to a second embodiment.

As shown in FIG. 7, the capillary force generating member 50 according to a second embodiment has a plurality of grooves 70 that extend in the longitudinal direction of the projection 52. The width of the grooves 70 becomes narrower as the grooves 70 come closer to the suction opening 44. With this structure, the ink on the projection 52 is led toward the suction opening 44 by the capillary force generated in the grooves 70. Thus, the ink in the recess 43 is reliably discharged through the suction opening 44 outside the suction cap 41, by the application of the suction force, without leaving behind ink in the recess 43.

Figure 8:
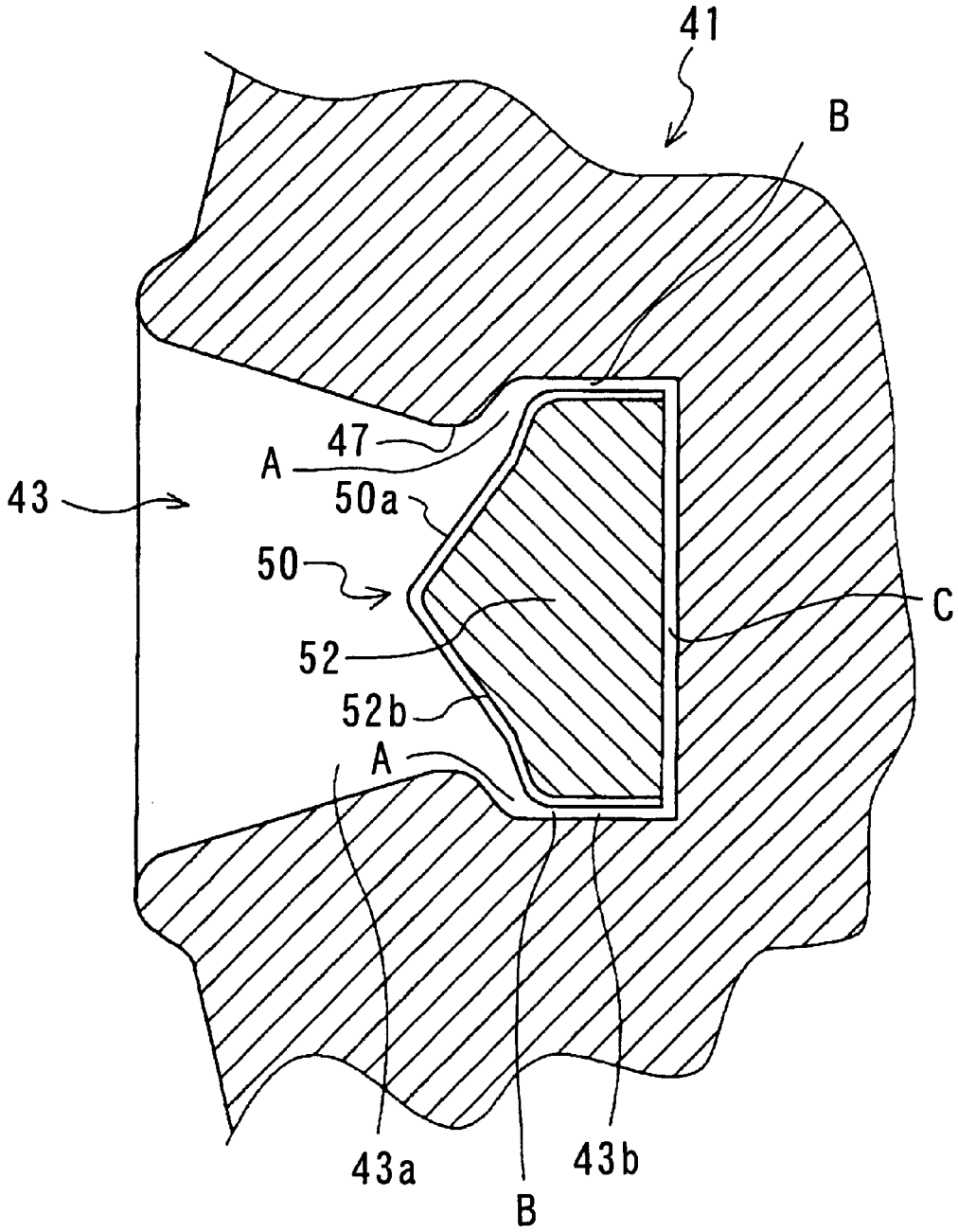
FIG. 8 is a sectional view of a capillary force generating member according to a third embodiment.

As shown in FIG. 8, the capillary force generating member 50 according to a third embodiment has a generally triangular or convex cross section orthogonal to the longitudinal direction of the projection 52. The projection 52 has a tilt surface 52*b* extending from a top thereof toward the space A. The surfaces of the capillary force generating member 50 are coated with a high water-repellent film 50*a*, such as a fluoric film or a silicone film. Alternatively, the capillary force generating member 50 may be formed of a resin material having a high water repellency, such as fluoroplastics and silicone resin. The structure renders the surface of the capillary force generating member 50 repellent to ink, causing the ink to quickly flow down along the tilt surface 52*b* into the space A. The ink in the space A flows by the capillary force, generated in the spaces B and C, between the second part 43*b* and the capillary force generating member 50.

When an upper portion of the projection 52 is flat or the angle of the tilt surface 52*b* is not sharp, the ink may stay on the upper portion of the projection 52 even if the ink becomes drop like due to the water repellency of the capillary force generating member 50. In view of this, the capillary force generating member 50 having a high wettability, such as the above-described capillary force generating member 50, may be preferred. However, if the tilt surface 52*b* is provided at an angle greater than a predetermined amount, the ink flows and is smoothly discharged with synergistic effects of water-repellency of the capillary force generating member 50 and the tilt angle of the tilt surface 52*b*. The capillary force generating member 50 may be tilted or angled with respect to the direction of a length thereof, as shown in FIG. 3. The tilt angle F, which is indicated in FIG. 3, is preferably about five degrees or greater, with respect to the level surface. The tilt angle F has a first component in the slope of the bottom 46 and a second component in the slope of the top of the projection 52. It is preferable that the tilt be provided on the capillary force generating member 50 in the widthwise direction thereof, orthogonal to the longitudinal direction of the projection 52, as shown in FIG. 8, because the greater tilt angle may be provided.

Figure 9:
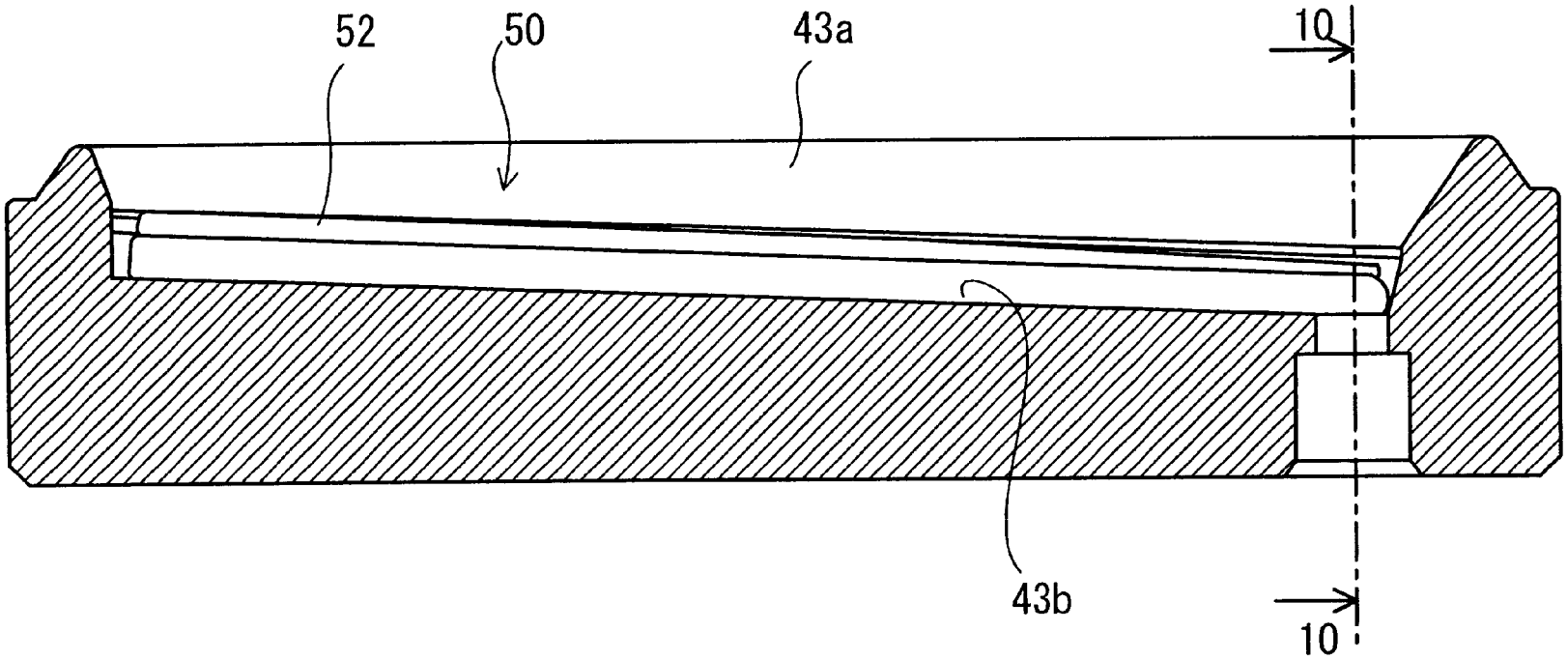
FIG. 9 is a sectional view of the suction cap, taken along a length thereof.
Figure 10:
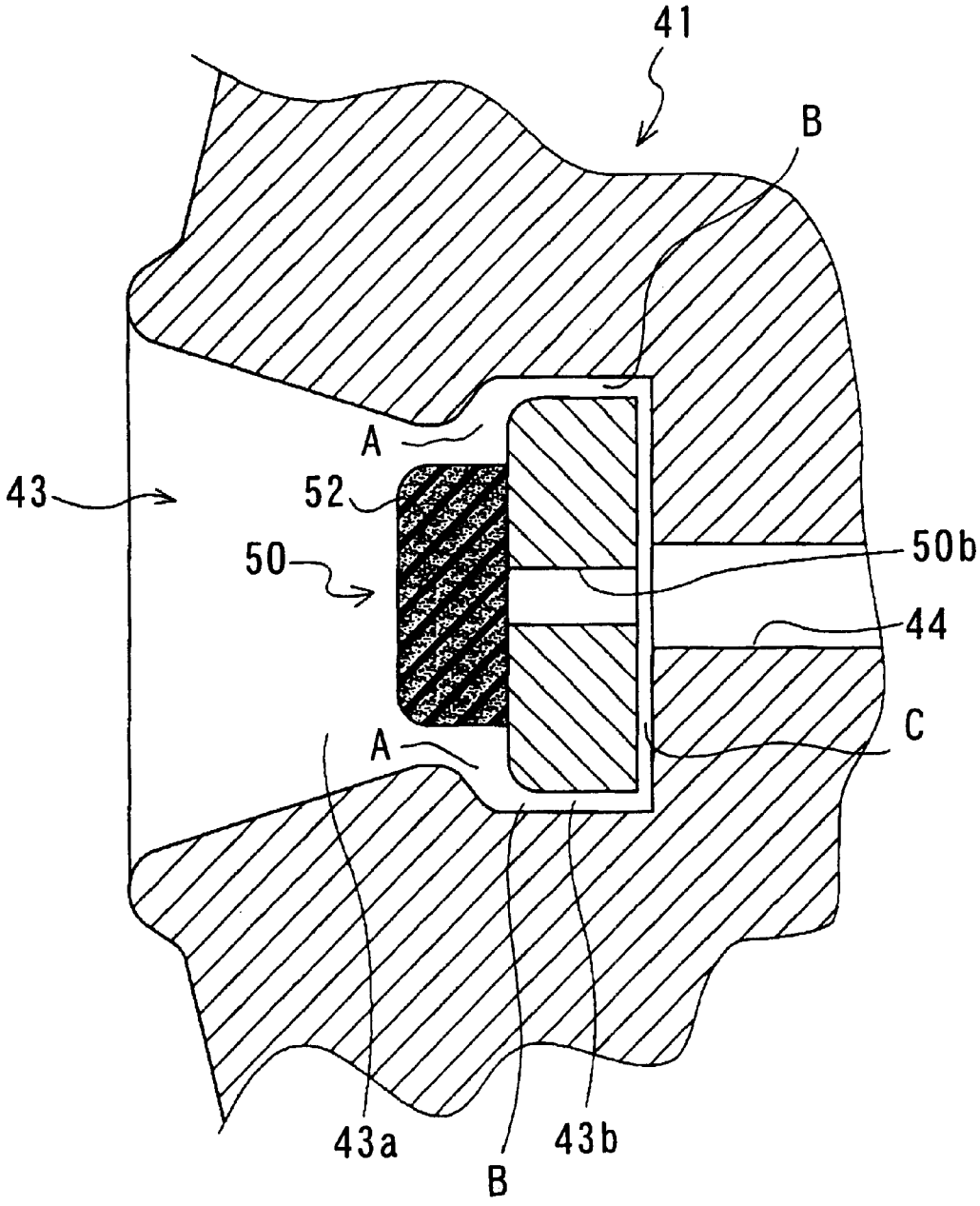
FIG. 10 is a sectional view of the suction cap, taken along a line 10—10 in FIG. 9.

As shown in FIGS. 9 and 10, the projection 52 of the capillary force generating member 50 according to a fourth embodiment, is formed of an ink absorbable material, such as porous material having fluid absorbing properties. For the ink absorbable material, polyurethane foam or a felt-like fiber layers may be used. In this case, a hole 50*b* is formed in the capillary force generating member 50 so as to face to the suction opening 44, as shown in FIG. 10. The ink absorbed by the projection 52 is discharged through the hole 50*b*. With this structure, the ink in the recess 43 frothing immediately after the purge operation is performed, is absorbed by the projection 52 of the capillary force generating member 50 that has fluid absorbing properties. The absorbed ink is discharged from the recess 43, through the hole 50*b* and the suction opening 44, so that the occurrence of the frothing ink in the recess 43 is prevented or reduced. Further, the ink is prevented by capillarity from being left in the recess 43.

In the above described embodiments, the suction cap 41 is used only to suck ink. However, the suction cap may be used to suck ink and protect the print heads 24. The suction cap 41 in the above-described embodiments has a size for covering the nozzles for only one color at a time. However, the suction cap 41 may have such a size that it covers the nozzles of a plurality of print heads 24 for a plurality of colors at one time. Further, a plurality of the suction caps 41, each suction cap 41 covering the nozzles for a different color, may be provided and, correspondingly, a plurality of the suction pumps 38 may be provided, one for each of the suction caps 41.

While the invention has been described with reference to the embodiments, it is to be understood that the invention is not restricted to the particular forms shown in the foregoing embodiments. Various modifications and alterations can be made thereto without departing from the scope of the invention, as set forth in the appended claims.

For example, the suction cap 41 adapted for the ink-jet print heads 24 that eject a plurality of colors of ink are employed in the above-described embodiments. However, the suction cap 41 adapted for an ink-jet print head that ejects one color of ink may be used.

In the above-described embodiments, the ejection surface 24*a* of the ink-jet print head 24 faces downwardly. However, the ejection surface 24*a* may face toward a downward slanting direction or toward a side (in the horizontal direction). The latter case, or a downward slanting direction would require the lower end of the suction cap to be a flat surface or to have a downward slope toward the opening relative to the horizontal surface on which the ink-jet recording apparatus is replaced.

What is claimed is:

1. An ink-jet recording apparatus, comprising:

a recording head including an ejection surface and at least one nozzle formed thereon for recording onto a recording medium by ejecting ink from the nozzle;

a cap device for covering the ejection surface of the recording head, the cap device including:

a cap member including a contact portion able to be in contact with the ejection surface and a recess forming a room with the ejection surface of the recording head when the cap member contacts to the ejection surface of the recording head, and a suction opening communicating with the recess through which ink is sucked; and a capillary force generating member separately formed from the cap member, the capillary force generating member disposed in the cap member to form spaces with an inner surface of the recess of the cap member so that a capillary force is generated toward a part of the inner surface of the recess where the suction opening is formed; and a suction device connected to the suction opening of the cap member for sucking the ink of the recording head through the nozzle and discharging the sucked ink from the cap device through the suction opening.

2. The ink-jet recording apparatus according to claim 1, wherein the recess of the cap member comprises a first recessed portion located contiguously to the contact portion, and a second recessed portion continuous with the first recessed portion and located opposite the contact portion with respect to the first recessed portion, the second recessed portion having disposed therein the capillary force generating member with the spaces, and the second recessed portion communicates with the suction opening.

3. The ink-jet recording apparatus according to claim 2, wherein the cap member includes an elastically-deformable protrusion that protrudes from the inner surface thereof so as to narrow the continuous portion between the first recessed portion and second recessed portion, and the capillary force generating member is held between the protrusion and a bottom face of the second recessed portion.

4. The ink-jet recording apparatus according to claim 3, wherein the capillary force generating member includes a projection that projects into the first recessed portion beyond the protrusion of the cap member, and the protrusion and the projection of the capillary force generating member define one of the spaces.

5. The ink-jet recording apparatus according to claim 4, wherein the other of the spaces between the capillary force generating member and the inner surface of the second recessed portion is smaller than the one of the spaces between the projection and the protrusion.

6. The ink-jet recording apparatus according to claim 4, wherein the projection of the capillary force generating member includes, on a side thereof facing the first recessed portion, at least one groove whose width becomes smaller as the at least one groove approaches the suction opening.

7. The ink-jet recording apparatus according to claim 4, wherein the projection of the capillary force generating member includes a tilt surface that is provided at such an angle that a droplet of the ink moves by an own weight thereof, the tilt surface having a water repellency.

8. The ink-jet recording apparatus according to claim 7, wherein the tilt surface of the projection of the capillary force generating member is directed toward the one of the spaces formed by the projection and the protrusion.

9. The ink-jet recording apparatus according to claim 4, wherein at least a part of the projection of the capillary force generating member is formed of a porous material having a fluid absorbing property.

10. The ink-jet recording apparatus according to claim 9, wherein the capillary force generating member includes an opening provided beneath the projection that communicates with the suction opening through the capillary force generating member.

11. The ink-jet recording apparatus according to claim 2, wherein the first recessed portion consists of tapered faces gradually becoming narrower toward the second recessed portion.

12. The ink-jet recording apparatus according to claim 2, wherein a part of the inner surface of the second recessed portion where the suction opening is formed is tilted toward the suction opening.

13. The ink-jet recording apparatus according to claim 1, wherein the capillary force generating member is disposed so as to partially cover the suction opening on the side of the recess.

14. The ink-jet recording apparatus according to claim 1, wherein the recording head includes a plurality of nozzles aligned in a row, the capillary force generating member extends in a same direction as the row.

15. The ink-jet recording apparatus according to claim 1, wherein the capillary force generating member has a better wettability than the inner surface of the recess.

16. The ink-jet recording apparatus according to claim 15, wherein the capillary force generating member includes a surface sandblasted or coated with elastomer to have a high wettability.

17. The ink-jet recording apparatus according to claim 1, wherein the suction opening is formed at a lowest position with respect to a vertical direction, in the part of the inner surface of the recess facing the ejection surface of the recording head when the cap member contacts the ejection surface of the recording head.

18. The ink-jet recording apparatus according to claim 17, wherein the ejection surface of the recording head faces downward with respect to the vertical direction, and the part of the inner surface of the recess is tilted toward the suction opening.

19. A cap for use with an ink-ejection recovery device to oppose an ejection surface of a print apparatus, the cap comprising:

a cap member having:

a first axis;

a second axis transverse to the first axis;

a perimeter wall, an upper surface of the perimeter wall forming a contact lip for engaging the ejection of the cap surface;

a base having an opening at one end of the first axis proximate the perimeter wall; and a protrusion extending from an inner surface of the perimeter wall at least along each portion of the perimeter wall extending along the first axis; and a capillary force generating member mounted in the cap member and retained therein by the protrusion.

20. The cap according to claim 19, wherein the base and the perimeter wall define a recess, the protrusion dividing the recess into a first recess and a second recess, the capillary force generating member retained in the second recess.

21. The cap according to claim 20, wherein the capillary force generating member has a substantially upside down T-shape in cross section, a cross bar of the T-shape retained in the second recess and a base leg of the T-shape extending between the protrusions.

22. The cap according to claim 21, wherein the base leg has a substantially flat end, the flat end extending beyond the protrusion into the first recess.

23. The cap according to claim 22, wherein the substantially flat end has at least one groove extending along the first axis and narrowing toward an end proximate the opening.

24. The cap according to claim 22, wherein the capillary force generating member has a roughened surface to have a greater wettability than a surface of the recess.

25. The cap according to claim 21, wherein the base leg has a substantially triangular or convex shape in cross section, an apex or peak of the shape extending beyond the protrusion into the first recess.

26. The cap according to claim 25, wherein surfaces of the capillary force generating member are coated with a water repellant film.

27. The cap according to claim 25, wherein the capillary force generating member is made of a water repellant material.

28. The cap according to claim 21, wherein the base leg is formed of an ink absorbable material and the cross bar has an opening that overlaps, at least in part, the opening in the base.

29. The cap according to claim 20, wherein a depth of the recess at an end of the first axis where the opening is located is greater than a depth of the recess at the other end of the first axis.

30. The cap according to claim 20, further comprising a regulating surface in the second recess at an end of the first axis where the opening in the base is located, the regulating surface preventing the capillary force generating member from completely overlying the opening.

31. The cap according to claim 19, wherein an inner surface of the perimeter wall from the contact lip to the protrusion is a substantially flat tilt surface.

* * * * *